United States Patent [19]

Papesh

[11] Patent Number: 4,836,010

[45] Date of Patent: Jun. 6, 1989

[54] FLOOR PULLER TO STRAIGHTEN A BENT MEMBER

[76] Inventor: Thomas S. Papesh, 1915 N. Broadway, Crest Hill, Ill. 60435

[21] Appl. No.: 154,541

[22] Filed: Feb. 10, 1988

[51] Int. Cl.[4] ..... B21D 01/12

[52] U.S. Cl. ..... 72/447; 72/705

[58] Field of Search ..... 72/447, 705

[56] References Cited

U.S. PATENT DOCUMENTS

| | | | |
|---|---|---|---|
| 3,340,720 | 9/1967 | Chartier | 72/705 |
| 3,398,565 | 8/1968 | Whitney | 72/705 |
| 3,492,855 | 2/1970 | Wylie | 72/705 |
| 3,581,547 | 6/1971 | Estigarribia | 72/705 |
| 3,612,482 | 10/1971 | Eck | 72/705 |
| 3,955,397 | 5/1976 | Meis | 72/705 |
| 4,501,136 | 2/1985 | Celette | 72/705 |
| 4,712,417 | 12/1987 | Jarman et al. | 72/705 |

*Primary Examiner*—Lowell A. Larson
*Attorney, Agent, or Firm*—Ernest Kettelson

[57] ABSTRACT

A floor puller to straighten a bent member such as bent portions on an auto body, which comprises a base and an upright post that supports a pulling mechanism and which can be anchored to the floor while the pulling mechanism straightens the item that has been bent. The pulling mechanism is carried on a sleeve which slides on the post to any desired height where it is then secured, and the sleeve is rotatable on the support post. The pulling mechanism includes an elongated slide member having a pulling end to which a pull chain is connected for pulling on the bent member, and an opposite operating end connected to the pressure chamber of a hydraulic cylinder. The ram of the hydraulic cylinder is connected to a coupling member on the sleeve, and when the ram is extended the slide member is forced rearwardly to pull the bent member into its original straightened position. The anchor connecting member is also secured to the sleeve, for connection of an anchor chain whose opposite end is connected to an anchor ring or anchor bolt on the floor. The slide member, the coupling member and the anchor connecting member are all pivotally mounted on the sleeve, and the sleeve is rotatably mounted on the post. This enables the entire pulling mechanism to contiually orient itself in a straight line with the bent object in the direction of pull. Since the entire pulling mechanism is mounted on a sleeve, it is easy to assemble on the support post and it also permits mounting of two sleeves and pulling mechanisms on the same support post which is desirable for certain straightening and body repair operations.

19 Claims, 4 Drawing Sheets

FLOOR PULLER TO STRAIGHTEN A BENT MEMBER

BACKGROUND OF THE INVENTION

This invention relates to the field of floor pullers for straightening bent members, particularly bent portions of auto bodies.

Floor pullers are used in auto body repair shops to pull bent portions of a damaged auto body while it is being held and clamped to a supporting bench. The floor puller is moved to a desired location facing the damaged part of the auto body, an anchor chain is connected between the floor puller and an anchor post or ring in the floor of the shop, and a pull chain is connected between the bent member and the mechanism of the floor puller which exerts the pulling force usually powered by a hydraulic pump or similar power source.

Prior art floor pullers include such things as pulleys and levers as part of the pulling mechanism which besides being cumbersome and expensive impose excessive force on pivot pins and pulley shafts. They are subject to excessive wear and breakage. They also are unable to pivot and rotate while a bent part is being pulled to continually adjust to a true straight line between the part being straightened and the direction being faced by the pulling mechanism. A typical prior art floor puller includes a pair of spaced apart, upwardly extending beams having pulleys rotatably mounted in between on pulley shafts supported by the pair of upright beams. The pull chain extends around the pulleys to a drive mechanism powered by a hydraulic pump. The pulling mechanism is not able to rotate about the longitudinal axis of the upright beams, nor can two separate pulling mechanisms be mounted on the same support member. If two pull chains are needed for pulling at different angles, two separate floor pullers of this prior art design must be used.

The floor puller in accordance with the present invention is able to solve these problems. The pulling mechanism including the power drive mechanism is free to both rotate on a vertical axis and pivot on a horizontal axis to continually orient itself in a straight line with the direction of pull from the connection to the bent part. No pulleys or levers are needed. And two pulling mechanisms in accordance with the present invention may be mounted and used on the same single floor puller. The detail construction which enable accomplishment of these features is described herein below.

SUMMARY OF THE INVENTION

It is an object of the invention to provide a floor puller to straighten a bent member such as portions of a damaged auto body wherein the pulling mechanism is both rotatable on a vertical axis and pivotable on a horizontal axis for continuous straight line orientation with the direction of pull.

It is an object of the invention to provide a floor puller to straighten a bent member such as portions of a damaged auto body wherein pulleys and levers are not needed.

It is an object of the invention to provide a floor puller to straighten a bent member wherein the operating portions of the pulling mechanism are assembled on a sleeve member which is slidable on a cylindrical post to any desired operating height and securable at such point in a way whereby it can then rotate on the cylindrical post.

It is an object of the invention to provide a floor puller to straighten a bent member on which more than one pulling mechanism may be mounted for operation together from different angles when that is needed for straightening a bent member in certain situations.

DESCRIPTION OF PREFERRED EMBODIMENT

Figure 1:
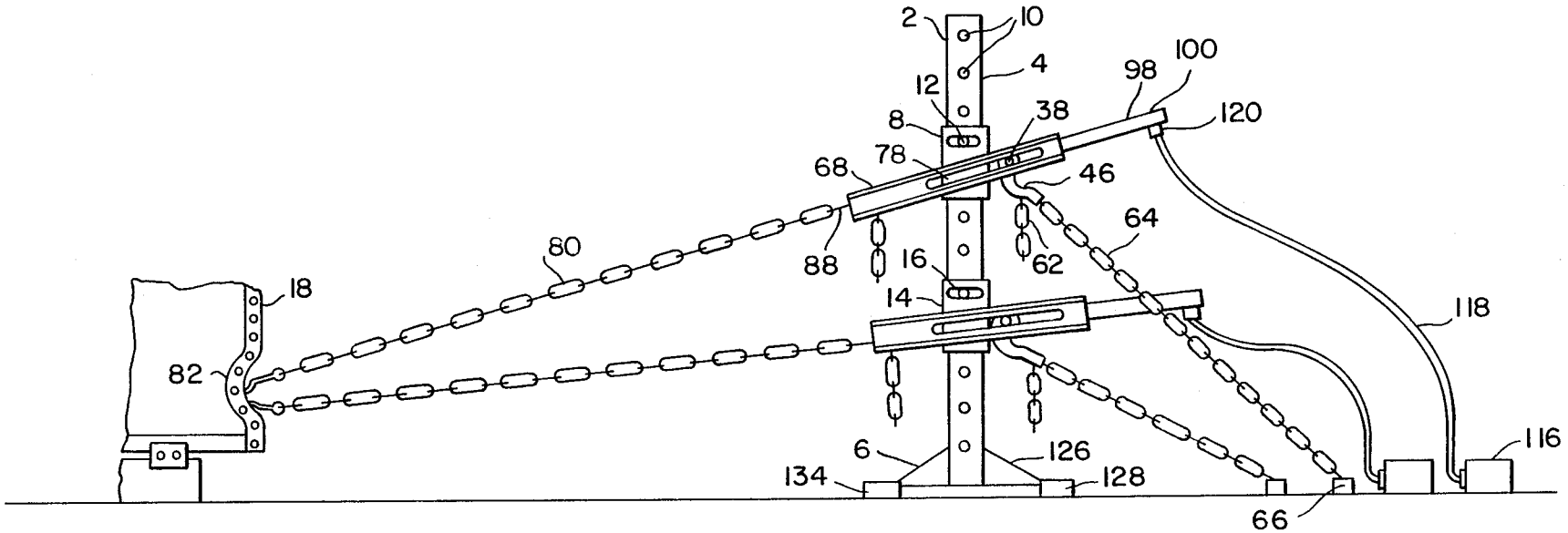
FIG. 1 is a side elevation view of a floor puller for straightening a bent auto body or other bent object, showing two pulling mechanisms in accordance with this invention mounted on a single post, both connected to portions of the bent frame for pulling at different angles to achieve more true straightening of the bent part.
Figure 2:
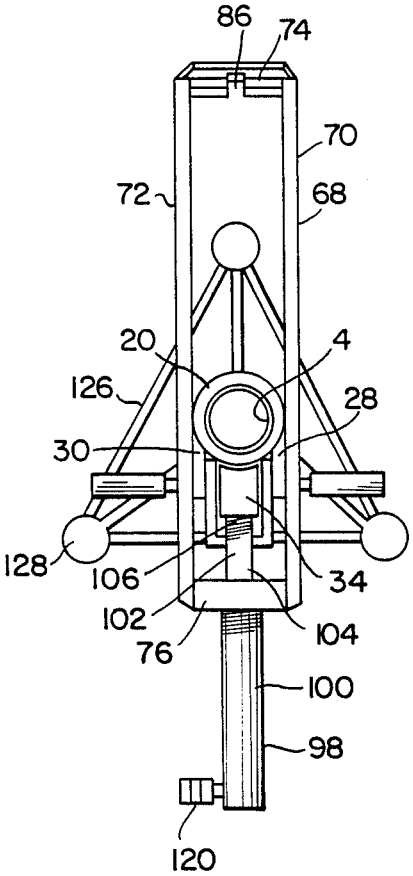
FIG. 2 is a top plan view of a floor puller in accordance with this invention.
Figure 3:
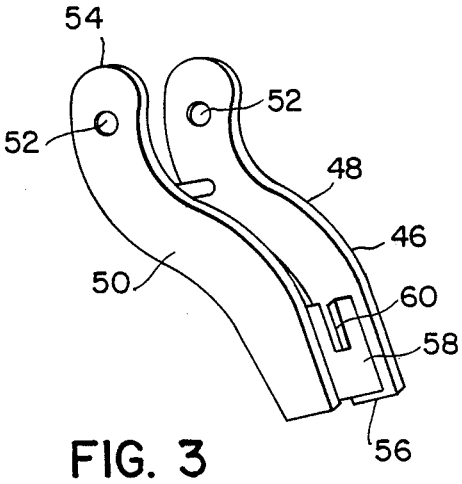
FIG. 3 is a perspective view of the anchor chain connector for connection of an anchor chain to anchor the floor puller while the pulling mechanism is being operated.
Figure 4:
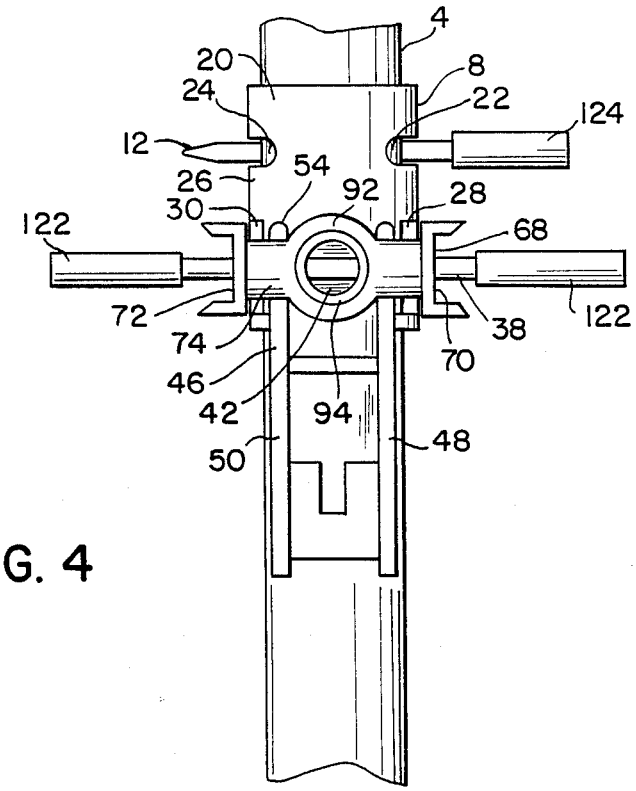
FIG. 4 is an elevation view from the rear of the pulling mechanism portion of the floor puller in accordance with this invention.
Figure 5:
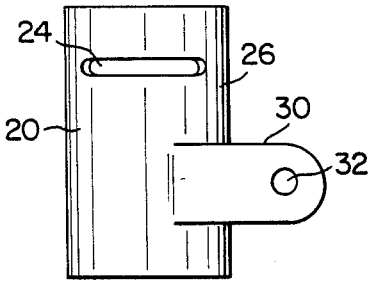
FIG. 5 is a side elevation view of the sleeve portion of pulling mechanism which is slidingly mounted on the upright post.
Figure 6:
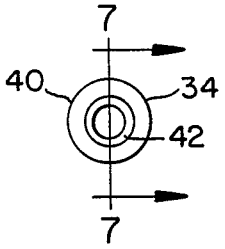
FIG. 6 is an end elevation view of the coupling member which receives and holds the free end of the ram of the hydraulic cylinder used to operate the pulling mechanism.
Figure 7:
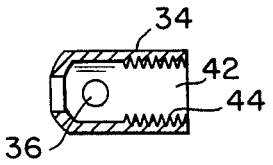
FIG. 7 is a section view taken on line 7—7 of FIG. 6.
Figure 8:
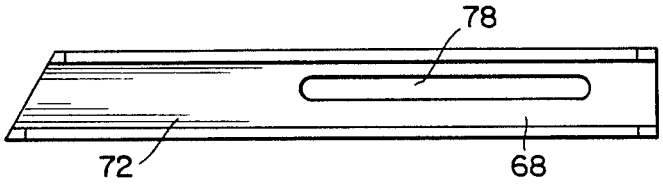
FIG. 8 is a side elevation view of the elongated reciprocating frame member portion of the pulling mechanism.
Figure 9:
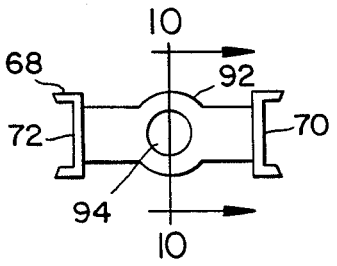
FIG. 9 is an end view of the elongated reciprocating frame member shown in FIG. 8.
Figure 10:
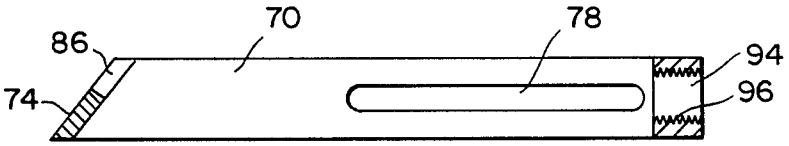
FIG. 10 is a section view taken on line 10—10 of FIG. 9.
Figure 11:
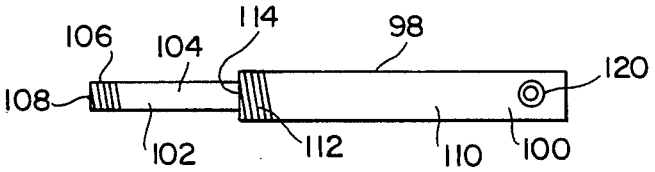
FIG. 11 is a side elevation view of a hydraulic cylinder to operate the pulling mechanism.
Figure 12:
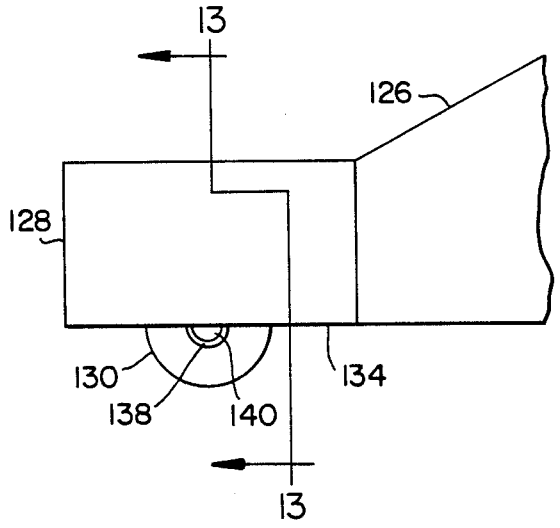
FIG. 12 is a side elevation view showing one of the wheel chambers and a portion of the connecting base arm broken away.
Figure 13:
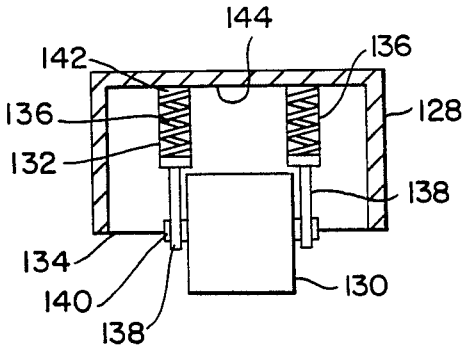
FIG. 13 is a section view taken on line 13—13 of FIG. 12.

A floor puller 2 for straightening auto bodies in accordance with this invention includes an elongated cylindrical post 4 supported by a base 6 and extending upwardly therefrom to receive a pulling mechanism 8 thereon.

A plurality of apertures 10 are provided through the cylindrical post 4 spaced apart longitudinally thereof to receive a retaining bar 12 on which the pulling mechanism 8 is mounted.

A second pulling mechanism 14 may be mounted on a second retaining bar 16 through a second one of the apertures 10, spaced apart from the first pulling mechanism 8. The first pulling mechanism 8 can be connected to one part of an auto body 18 for straightening while the second pulling mechanism 14 is connected to another part thereof, the two pulling mechanisms being operated in conjunction with each other.

The pulling mechanism 8 includes a mounting sleeve 20 which is slidably positioned on the post 4. The mounting sleeve 20 has a pair of arcuately extending slots 22 and 24 through its cylindrical wall 26, slot 22 being diametrically opposite of slot 24. These slots 22 and 24 are aligned with one of the apertures 10 through the post 4 at the desired height for the pulling mechanism 8, and retaining bar 12 is placed through arcuate slot 22, aperture 10 and arcuate slot 24 to mount the pulling mechanism 8 on the post 4. The elongated arcuate slots 22 and 24 permit limited rotation of the pulling mechanism 8 on the post 4.

A pair of spaced apart projections or ears 28 and 30 project outwardly from the cylindrical wall 26 of sleeve 20, parallel to each other and having apertures 32 therethrough. A coupling member 34 is pivotally mounted between the projections or ears 28 and 30, having a connecting bore 36 therethrough in registration with apertures 32 of the ears 28 and 30. A connecting bar 38 is placed through the apertures 32 and connecting bore 36 to pivotally mount the coupling member 34 to the sleeve 20. The coupling member has a cylindrical wall 40 surrounding a cylindrical coupling recess 42 having internal screw threads 44. The axis of the coupling recess 42 extends at a right angle to the connecting bore 36, and in a vertical plane that extends at a right angle to the longitudinal axis of the post 4.

An anchor chain connector 46 is also pivotally mounted on the connecting bar 38, having a pair of curved arms 48 and 50 in parallel spaced apart relationship with aligned apertures 52 through end portion 54 in registration with apertures 32 of the sleeve ears 28 and 30 and connecting bore 36 to receive the connecting bar 38 therethrough. The curved arms 48 and 50 are spaced apart a sufficient distance to receive the coupling member 34 therebetween, and to themselves be received between the spaced apart ears 28 and 30 of the sleeve 20. The opposite end portion 56 of the anchor chain connector 46 includes a cleat 58 welded in place between the pair of curved arms 48 and 50, having a connecting slot 60 to receive and hold a link 62 of one end of an anchor chain 64. The other end of the anchor chain 64 is secured to an anchor ring or post 66 embedded in the floor of the work shop.

The anchor chain connector 46 is free to pivot on the connecting bar 38 on which it is mounted.

An operating frame 68 is also mounted on the connecting bar 38 for both pivotal and sliding movement thereon. The operating frame 68 includes a pair of elongated spaced apart side member 70 and 72, a pull chain connecting member 74 across one end between the side members 70 and 72 and an operating coupling member 76 across the opposite end thereof. The side members 70 and 72 are spaced apart a sufficient distance to receive the sleeve 20 and its projections or ears 28 and 30 therebetween. Each side member 70 and 72 includes an elongated slot 78 extending longitudinally thereof in registration with the apertures 32 of ears 28 and 30 to receive the connecting bar 38 through the slots 78 for mounting the operating frame 68 on the sleeve 20 and post 4. The elongated slots 78 enable sliding movement of the operating frame 68 between an extended position for connection of a pull chain 80 to a bent portion 82 of an auto body 18 that is to be straightened and a retracted position in which the auto body portion has been pulled sufficiently to straighten it.

The pull chain connecting member 74 includes a connecting slot 86 to receive a link 88 at one end of the pull chain 80 therein, the opposite end of the pull chain 80 being connected by a hook or other connecting device to the bent portion 82 of the auto body 18 that is to be straightened.

The operating coupling member 76 has a tubular wall 92 surrounding a cylindrical bore 94 extending therethrough, the cylindrical bore 94 having internal screw threads 96. The operating frame 68 and coupling member 34 may be pivoted on the connecting bar 38 to bring the coupling recess 42 of coupling member 34 into axial alignment with the cylindrical bore 94 of the operating coupling member 90 of the operating frame 68. A hydraulic cylinder 98 is then connected to the coupling member 34 and operating frame 68. The hydraulic cylinder 98 includes a cylindrical pressure chamber 100 and a reciprocating ram 102 mounted therein for reciprocating movement between an extended position and a retracted position. The ram 102 has a cylindrical wall 104 of a cross-sectional diameter corresponding to that of cylindrical recess 42 of the coupling member 34. Screw threads 106 are provided on the cylindrical wall 104 at the free end 108 thereof, whereby the free end of the ram 102 may be screwed into the internally threaded recess 42 of the coupling member 34. The cylindrical pressure chamber 100 has a cylindrical wall 110 of a cross-sectional diameter corresponding to that of the cylindrical bore 94 of the operating coupling member 90 of the operating frame 68. Screw threads 112 are provided on the cylindrical wall 110 at the ram end 114 thereof, whereby the ram end of the cylindrical pressure chamber 100 may be screwed into the internally threaded bore 94 of coupling member 90 of the operating frame 68.

When the hydraulic cylinder 98 is thus connected, it is in axial alignment with the longitudinal axis of the elongated operating frame 68, extending outwardly from one side of the cylindrical post 4 while the opposite end of the operating frame 68 having the pull chain connecting member 74 thereacross extends outwardly from the diametrically opposite side of the cylindrical post 4. The operating frame 68 may thus be slidingly moved on the connecting bar 38 by the hydraulic cylinder 98. When the ram 102 is in its retracted position, the coupling member end of operating frame 68 is drawn up close to the coupling member 34 and sleeve 20 whereby the pull chain end of operating frame 68 is in its extended position for connection of the pull chain 80 to a portion of an auto body that is to be straightened. Hydraulic pressure is then applied to the pressure chamber 100 by hydraulic pump 116 through hose 118 and hydraulic coupling 120 which forces the ram 102 toward its extended position. Since the post 4 is anchored by anchor chain 64 connected at one end to anchor chain connector 46 and at the other end to anchor post 66 whereby it cannot move relative to the floor, the pressure chamber 100 of hydraulic cylinder 98 is forced rearwardly as the ram 102 is moved toward its extended position. This carries with it the operating frame 68 whose coupling member end is coupled to the pressure chamber, and the operating frame thereby is moved from its extended toward its retracted position, pulling the pull chain 80 and portion of the auto body to be straightened a sufficient distance in that direction to straighten it whereupon operation of the hydraulic cylinder 98 is discontinued.

While the operating frame 68 is being pulled from its extended toward its retracted position, it is free to rotate on the post 4 with sleeve 20 by virtue of the arcuate slots 22 and 24 provided through the cylindrical wall 26 thereof. The operating frame 68 is also at such time free to pivot on the connecting bar 38. Thus, the pull chain end of the operating frame 68 and pull chain connecting member 84 across that end are free to continually adjust in both a horizontal plane of rotation and in a vertical plane of rotation as the damaged part of the auto body is being pulled whereby a continuously straight axial line of force is maintained between the hydraulic cylinder 98, the operating frame 68 and the pull chain 80. The longitudinal axes of these three components, hydraulic cylinder 98, operating frame 68 and the stretched pull chain 80, are able to stay in continuous axial alignment throughout the pull, from the extended position of operating frame 68 throughout its travel toward the retracted position. This enables a continuously straight pull on the damaged part which enables straightening it more nearly to its true original position, and it also prevents skewing of the post 4 as the damaged part is being pulled. This continuous in-line axial construction for the pulling force also reduces stress on the pivot pin or connecting bar 38.

The pivot pin or pins in pulling devices which use a leverage mechanism wherein the pivot pin serves as a fulcrum are subject to increased forces resulting from the mechanical advantage provided by the lever mechanism. The same is true for pulling devices which use a pulley, increased forces being applied to the pin on which the pulley rotates. Such pins are weak links in the total line of force for pulling devices which use levers and pulleys, and such weak links are eliminated by the continuous in-line axial structure of the pulling mechanism in accordance with this invention.

The connecting bar 38 includes removable hand grips 122 of rubber or comparable material at each projecting end. The retaining bar 12 may also include a hand grip 124.

The base 6 includes three outwardly extending arms 126 projecting outwardly from the cylindrical post 4 and terminating at respective wheel chambers 128. Each wheel chamber 128 includes a wheel 130 mounted for rotation on a resilient support 132 which is movable vertically to retract the wheel 130 into the wheel chamber 128 where it cannot roll on the floor and to extend the wheel 130 out of the wheel chamber 128 far enough to be in rolling engagement with the floor. When the wheels 130 are retracted into the wheel chambers 128, the floor puller 2 can't be rolled on the floor. The bottom edges 134 of the wheel chambers 128 are in frictional contact with the floor surface to act as a brake against movement of the floor puller 2 when the wheels 130 are retracted into the wheel chambers. The resilient support 132 normally biases the wheels 130 to their extended position outward of the wheel chambers 128 far enough for rolling engagement with the floor whereupon the floor puller 2 can be easily rolled from one location to another. When the anchor chain 64 is anchored to a floor post 66, the pull chain 80 connected to a part 82 for straightening, and the pulling mechanism 8 operated to pull on the pull chain 80, downward force is applied to the post 4 and base 6 forcing the wheels 130 to their retracted position within the wheel chambers 128, and the bottom edges 134 of the wheel chambers are forced into frictional and braking contact with the floor to hold the base 6 against movement while the pulling mechanism 8 is being operated.

The resilient support 132 may take a number of forms, including cylinders of compressed fluid connected to the wheels 130, resilient and compressible material such as rubber to normally bias a wheel support mechanism to the extended position but compressible enough to permit the wheels to retract into the wheel chambers under pressure, and various other means. The form shown and described herein includes a pair of compression springs 136 and support shafts 138 connected to the axle 140 of the wheel 130, the opposite end 142 of the springs being secured to the inner surface of the top wall 144 of the wheel chamber 128.

Figure 14:
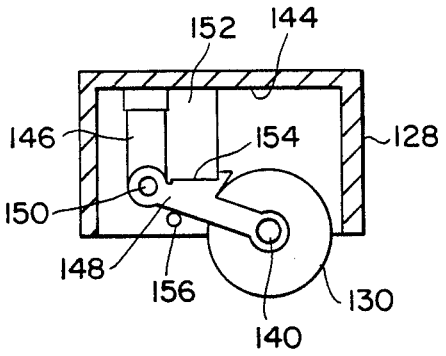
FIG. 14 is a section view of one of the wheel chambers illustrating a modified form of resilient support member wherein the wheel is in its outwardly extended position.
Figure 15:
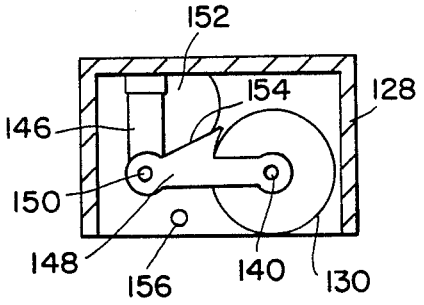
FIG. 15 is a section view of the wheel chamber and modified support member of FIG. 14 showing the wheel in its retracted position within the wheel chamber.

Another form of resilient support includes the modification shown in FIGS. 14 and 15. The wheel 130 is mounted so it can swivel on swivel post 146 which is secured to the inner surface of the top wall 144 of the wheel chamber 128 in this modification. The floor puller 2 can be more easily turned and steered when moved from one location to another when the wheels 130 are mounted so as to enable them to swivel. A connecting member 148 is pivotally connected at one end to the lower end of the swivel post 146 by pivot pin 150, and at the other end to the axle 140 of the wheel 130. Thus the wheel 130 can be pivoted from its extended position outward of the wheel chamber 128 as shown in FIG. 14 for rolling engagement with the floor to its retracted position where it is withdrawn from rolling engagement with the floor as shown in FIG. 15. A block of compressible material 152 such as rubber is provided as a compressible wedge between the inner surface of the top wall 144 and the bearing plate 154 formed on the upper surface of the connecting member 148. The block of compressible material 152 has sufficient rigidity to normally bias the wheel 130 to its extended position in rolling engagement with the floor, but is sufficiently resilient to enable the wheel 130 to retract into the wheel chamber 128 when the pulling mechanism 8 is being operated to pull on the bent member 82 thereby applying downward force on the cylindrical post 4. When such pressure is released, the block of compressible material 152 biases the wheel 130 back to its extended position in rolling engagement with the floor.

A stop bar 156 extends across the cavity of wheel chamber 128 to limit pivotal movement of the connecting member 148 and wheel 130 in the direction toward its extended position, and to hold it from further movement in such direction and when the wheel's extended position in rolling engagement with the floor has been reached.

The block of compressible material 152 extends entirely across the cavity of the wheel chamber 128 whereby the bearing plate 154 remains in continuous facing relationship therewith as the connecting member 148 and wheel 130 are swiveled for turning of the floor puller when the wheels 130 are in their extended position and the floor puller is being moved to a different location. At such time the block of compressible material 152 is in its relaxed or uncompressed state wherein it does not exert significant pressure against the bearing plate 154 thereby enabling the connecting member 148 and wheel 130 to swivel.

When two pulling mechanisms are mounted on the same support post as shown in FIG. 1, the rotatably mounted sleeves 20 permit rotating the two mechanisms to point in different lateral directions as well as at two different vertical angles. This unique feature enables one floor puller to do bi-directional pulling, such as in repairing a damaged auto body for example one pulling mechanism can be connected to pull out a bent frame rail and the other can be connected to pull out a bent portion of the upper cowl.

I claim:

1. A pulling device to straighten a bent member, comprising a vertically extending support member, a pulling mechanism supported thereon, said pulling mechanism including an elongated reciprocating member mounted for reciprocating movement between an extended position for connection to said bent member and a retracted position for pulling said bent member to straighten it, said elongated reciprocating member including a pulling end for connection to said bent member and an operating end connected to a power source, including first connecting means to connect said pulling end to said bent member and second connecting means to connect said operating end to a power source, including a said power source to move said reciprocating member from its said extended position toward its said retracted position, said reciprocating member being also mounted for movement of its said pulling end and operating end into alignment with the direction of pull when said pulling end is connected to said bent member and said power source connected to said operating end moves said reciprocating member from its said extended position toward its said retracted position, holding means to hold said support member against movement in the direction toward said bent member which is being pulled when said reciprocating member supported on said support member is being moved from its said extended toward its said retracted position, said power source including a ram member having a pivotal end and an opposite end, said opposite end of said ram being connected to said operating end of said elongated reciprocating member, a pivot pin supported on said vertically extending support member to extend horizontally in a direction normal to that of said vertically extending support member, said pivotal end of said ram member being positioned for arcuate movement around said horizontally extending pivot pin, said elongated reciprocating member including pivot connection means to pivotally connect said elongated reciprocating member on said horizontally extending pivot pin whereby external rotational forces applied to said elongated reciprocating member will center on the same horizontally extending pivot axis as that of said horizontally extending pivot pin.

2. A pulling device to straighten a bent member as set forth in claim 1, wherein said first connecting means to connect said pulling end of said elongated reciprocating member to said bent member includes a first chain, and said holding means to hold said support member against movement in the direction toward sent bent member includes a pulling chain.

3. A pulling device to straighten a bent member as set forth in claim 1, wherein said vertically extending support member comprises a base and a vertical post extending upwardly from said base, said elongated reciprocating member comprises an elongated frame having a pair of elongated spaced apart side members, said pulling end includes an end wall extending between said pair of spaced apart side members at said pulling end, said end wall including first securing means to secure said first connecting means thereto, said operating end includes a body portion extending between said pair of spaced apart side members at said operating end, said body portion including second securing means to connect said ram member thereto, said post being received between said pair of elongated spaced apart side members of said elongated reciprocating member, said pivot connection means to pivotally connect said elongated reciprocating member for pivotal movement on said horizontally extending pivot pin including an elongated slot in each of said elongated spaced apart side members to receive said horizontally extending pivot pin therethrough.

4. A pulling device to straighten a bent member as set forth in claim 3, wherein said first connecting means to connect said pulling end of said elongated reciprocating member to said bent member includes a chain, said first securing means of said end wall of said pulling end includes a slot to receive and hold a link of said chain, said ram member includes an elongated pressure chamber and an elongated plunger mounted therein for reciprocating movement between an extended and a retracted position, at least one of said pressure chamber and said plunger having a cylindrical outer wall and external threads at one end thereof, said body portion of said second securing means including a cylindrical coupling bore therethrough having internal threads to receive and hold said one of said pressure chamber and said plunger which has said cylindrical outer wall and external threads at one end thereof.

5. A pulling device to straighten a bent member as set forth in claim 3, wherein said first connecting means to connect said pulling end of said elongated reciprocating member to said bent member includes a first chain, said first securing means of said end wall of said pulling end includes a slot to receive and hold a link of said first chain, said ram member includes an elongated pressure chamber and an elongated plunger mounted therein and extending from one end thereof for reciprocating movement between an extended and a retracted position, said pressure chamber and said plunger both having a cylindrical outer wall, said plunger having external threads on its said cylindrical outer wall at the free end thereof, said pressure chamber having external threads on its said cylindrical outer wall at its end from which said plunger extends, said body portion of said second securing means including a cylindrical coupling bore therethrough having internal threads to receive and hold said externally threaded end of said pressure chamber, internally threaded coupling means pivotally mounted on said horizontally extending pivot pin to receive and hold said externally threaded end of said ram.

6. A pulling device to straighten a bent member as set forth in claim 5, including a sleeve member slidably received on said post, said sleeve member being received between said pair of elongated spaced apart side members of said elongated reciprocating member, said horizontally extending pivot pin being supported on said sleeve member and extending through each of said slots of said side members for reciprocating movement thereof between said extended and retracted positions of said elongated reciprocating member, said internally threaded coupling means comprising a coupling member having an internally threaded coupling recess therein opening to receive and hold said externally threaded end of said plunger, said coupling member having aperture means to receive said horizontally extending pivot pin therethrough, said aperture means of said coupling member having an axis which extends in a direction normal to the axis of said coupling recess thereof, said coupling member and said elongated reciprocating member being pivotable on said horizontally extending pivot pin to axially align said cylindrical coupling bore of said body portion at said operating end of said elongated reciprocating member and said coupling recess of said coupling member for respectively threading said threaded end of said plunger in said coupling recess and said threaded end of said pressure chamber in said coupling bore of said body portion of said elongated reciprocating member.

7. A pulling device to straighten a bent member as set forth in claim 6, wherein said holding means includes an anchor connecting member having a pair of elongated spaced apart side arms, a securing member between said spaced apart side arms to secure one end of an anchor line thereto, including said anchor line, apertures through said side arms at one end thereof to receive said horizontally extending pivot pin therethrough for pivotally mounting said anchor connecting member thereon, said coupling member pivotally mounted on said horizontally extending pivot pin being between said spaced apart side arms of said anchor connecting member, said sleeve member having a pair of spaced apart ear members projecting outward therefrom, apertures through said ear members to receive said horizontally extending pivot pin therethrough, said side arms of said anchor connecting member being between said spaced apart ear members, said ear members being between said spaced apart side members of said elongated reciprocating member.

8. A pulling device to straighten a bent member as set forth in claim 7, wherein said vertical post is cylindrical, said sleeve includes a cylindrical side wall, a first arcuately extending slot through said cylindrical side wall of said sleeve, projecting means extending from said post through said arcuately extending slot through said side wall of said sleeve member to hold said sleeve member from vertical movement upwardly and downwardly on said post and for limited rotation thereon, said sleeve member being rotatable on said vertical post through an arc defined by each opposite end of said arcuate slot.

9. A pulling device to straighten a bent member as set forth in claim 8, including a second arcuately extending slot through said cylindrical side wall of said sleeve diametrically opposite from said first arcuately extending slot, said vertical post including an aperture therethrough in registration with said first and second arcuate slots, said projecting means includes a positioning bolt extending through said aperture of said vertical post and through said first and second arcuate slots to thereby hold said sleeve member on said post against vertical movement thereon and for said limited rotation thereon, through an arc defined by respective opposite ends of each of said arcuate slots.

10. A pulling device to straighten bent member as set forth in claim 9, wherein said vertical post includes a plurality of post apertures therethrough spaced apart longitudinally thereof, said sleeve being slidable on said vertical post to align said arcuate slots thereof with any one of said plurality of post apertures for placing said positioning bolt therethrough to position said sleeve at different selected heights on said post.

11. A pulling device to straighten a bent member as set forth in claim 10, including a second sleeve member having a cylindrical wall on said cylindrical post, said second sleeve member having a pair of diametrically opposed arcuate slots through its said cylindrical wall, said arcuate slots of said second sleeve member being aligned with a second aperture on said post spaced apart from said first mentioned sleeve member, a second positioning bolt extending through said second aperture of said post and through said pair of diametrically opposed arcuate slots of said second sleeve member to thereby hold said second sleeve member on said post for limited rotation thereon through an arc defined by respective opposite ends of each of said diametrically opposed arcuate slots of said second sleeve member, said second sleeve member including spaced apart ear members projecting from its said side wall having apertures therethrough, and a second horizontally extending pivot pin through said apertures of said ear members of said second sleeve member to support a second one of said pulling mechanisms thereon.

12. A floor puller to straighten a bent member as set forth in claim 1, wherein said vertically extending support member includes an upwardly extending post and a laterally extending base, at least one rotatable member connected to said base for rolling engagement with the surface on which said floor puller is to be positioned for use, third connecting means to connect said rotatable member to said base for movement of said rotatable member between a retracted position out of rolling engagement with said surface and an extended position wherein it is in rolling engagement with said surface, and biasing means on said base to normally bias said rotatable member to its said extended position and to permit said rotatable member to move to its said retracted position when said pulling mechanism exerts pulling force on said bent member.

13. A floor puller to straighten a bent member as set forth in claim 12, including a plurality of rotatable members connected to said base for rolling engagement with the surface on which said floor puller is to be positioned for use, said third connecting means includes an axle for each of said rotatable members to rotate on, and a connecting member for each of said rotatable members connected between said axle and said biasing means.

14. A floor puller to straighten a bent member as set forth in claim 13, wherein said rotatable members are wheels and said biasing means are compression springs.

15. A floor puller to straighten a bent member as set forth in claim 12, wherein said biasing means is a block of compressible material to normally bias said rotatable member to its said extended position when said block of compressible material is in its expanded uncompressed state and to be compressible to enable said rotatable member to move to its said retracted position when said pulling mechanism exerts pulling force on said bent member.

16. A floor puller to straighten a bent member as set forth in claim 15, wherein said third connecting means includes a swivel post connected to enable said rotatable member to swivel for steering said floor puller when said rotatable member is in its said extended position for rolling engagement with said surface on which said floor puller is positioned and moved.

17. A pulling device to straighten a bent member, comprising a vertically extending support member, a pulling mechanism supported thereon, said pulling mechanism including an elongated reciprocating member mounted for reciprocating movement between an extended position for connection to said bent member and a retracted position for pulling said bent member to straighten it, said elongated reciprocating member including a pulling end for connection to said bent member and an operating end connected to a power source, including first connecting means to connect said pulling end to said bent member and second connecting means to connect said operating end to a power source, including a said power source to move said reciprocating member from its said extended position toward its said retracted position, said reciprocating member having a longitudinal axis extending between its said pulling end an its said operating end, said reciprocating member being also mounted for universal aligning movement of its said longitudinal axis both vertically and horizontally into alignment with the direction of pull when said pulling end is connected to said bent member and said power source connected to said operating end moves said reciprocating member from its said extended position toward its said retracted position and for continual aligning movement throughout movement of said reciprocating member toward its said retracted position to keep its said longitudinal axis in alignment with the said direction of pull, holding means to hold said support member against movement in the direction toward said bent member which is being pulled when said reciprocating member supported on said support member is being moved from its said extended toward its said retracted position, said power source including a ram member having a pivotal end and an opposite end, said opposite end of said ram being connected to said operating end of said elongated reciprocating member, a pivot pin supported on said vertically extending support member to extend horizontally in a direction normal to that of said vertically extending support member, said pivotal end of said ram member being positioned for arcuate movement around said horizontally extending pivot pin, said elongated reciprocating member including pivot connection means to pivotally connect said elongated reciprocating member on said horizontally extending pivot pin whereby external rotational forces applied to said elongated reciprocating member will center on the same horizontally extending pivot axis as that of said horizontally extending pivot pin.

18. A pulling device to straighten a bent member as set forth in claim 17, wherein said first connecting means to connect said pulling end to said bent member includes a length of flexible material stretchable to a straight line when pulled by movement of said reciprocating member toward its said retracted position, said length of flexible material when pulled into said straight line being continually aligned with said longitudinal axis of said reciprocating member throughout movement thereof toward its said retracted position.

19. A pulling device to straighten a bent member as set forth in claim 18, wherein said ram member is mounted for reciprocal movement in a straight line between a first position wherein said elongated reciprocating member connected thereto is in its said extended position and a second position wherein said elongated reciprocating member is in its said retracted position, said ram member having a longitudinal axis, said length of flexible material when pulled into a said straight line, said longitudinal axis of said elongated reciprocating member, and said longitudinal axis of said ram member all being continuously aligned one with the other in a straight line throughout continued movement of said reciprocating member toward its said retracted and of said ram member toward its said second position.

* * * * *